US008292408B2

(12) United States Patent
Scardovi

(10) Patent No.: US 8,292,408 B2
(45) Date of Patent: Oct. 23, 2012

(54) INKJET PRINTHEAD

(75) Inventor: Alessandro Scardovi, Ivrea (IT)

(73) Assignee: Telecom Italia S.p.A., Milan (IT)

( * ) Notice: Subject to any disclaimer, the term of this patent is extended or adjusted under 35 U.S.C. 154(b) by 757 days.

(21) Appl. No.: 12/303,077

(22) PCT Filed: Jun. 1, 2006

(86) PCT No.: PCT/EP2006/005226
§ 371 (c)(1),
(2), (4) Date: Jul. 13, 2009

(87) PCT Pub. No.: WO2007/137614
PCT Pub. Date: Dec. 6, 2007

(65) Prior Publication Data

US 2009/0303296 A1 Dec. 10, 2009

(51) Int. Cl.
*B41J 2/05* (2006.01)

(52) U.S. Cl. ..... 347/66; 347/56

(58) Field of Classification Search ..... 347/20, 347/44, 54, 61, 65, 87; 29/890.1
See application file for complete search history.

(56) References Cited

U.S. PATENT DOCUMENTS

| | | | | |
|---|---|---|---|---|
| 6,132,033 | A * | 10/2000 | Browning et al. | 347/63 |
| 6,309,054 | B1 * | 10/2001 | Kawamura et al. | 347/65 |
| 6,402,972 | B1 | 6/2002 | Weber et al. | |
| 6,455,112 | B1 * | 9/2002 | Ohkuma et al. | 427/504 |
| 6,472,125 | B1 * | 10/2002 | Koide et al. | 430/320 |
| 6,543,879 | B1 | 4/2003 | Feinn et al. | |
| 6,719,913 | B2 | 4/2004 | Conta et al. | |
| 6,890,063 | B2 | 5/2005 | Kim | |
| 6,921,152 | B2 * | 7/2005 | Fukunaga et al. | 347/44 |
| 7,254,890 | B2 * | 8/2007 | Barnes et al. | 29/890.1 |
| 2002/0109753 | A1 | 8/2002 | Leu et al. | |
| 2003/0137561 | A1 | 7/2003 | Conta et al. | |

FOREIGN PATENT DOCUMENTS

| | | | |
|---|---|---|---|
| EP | 0 842 776 | A2 | 5/1998 |
| EP | 0 997 284 | A2 | 5/2000 |
| EP | 1 264 693 | A2 | 12/2002 |
| EP | 1 415 811 | A1 | 5/2004 |

OTHER PUBLICATIONS

International Search Report, and Written Opinion mailed Feb. 5, 2007, issued in PCT/EP2006/005226.

* cited by examiner

*Primary Examiner* — Anh T. N. Vo
(74) *Attorney, Agent, or Firm* — Venable LLP; Robert Kinberg; Steven J. Schwarz

(57) ABSTRACT

An inkjet printhead comprising a substrate having an ink feed slot formed in the substrate and having a first longitudinal edge and a second longitudinal edge opposite to the first longitudinal edge, the first longitudinal edge extending along a first longitudinal axis (X); a first row of vaporization chambers arranged along the first longitudinal edge and a second row of vaporization chambers arranged along the second longitudinal edge, in which each chamber comprises an ink droplet generating portion and a connection portion, the connection portion including at least one duct in fluid connection with the ink feed slot, wherein the connection portions of the chambers of the first row overlap along the first longitudinal axis (X) with the connection portions of the chambers of the second row.

17 Claims, 5 Drawing Sheets

FIG 2
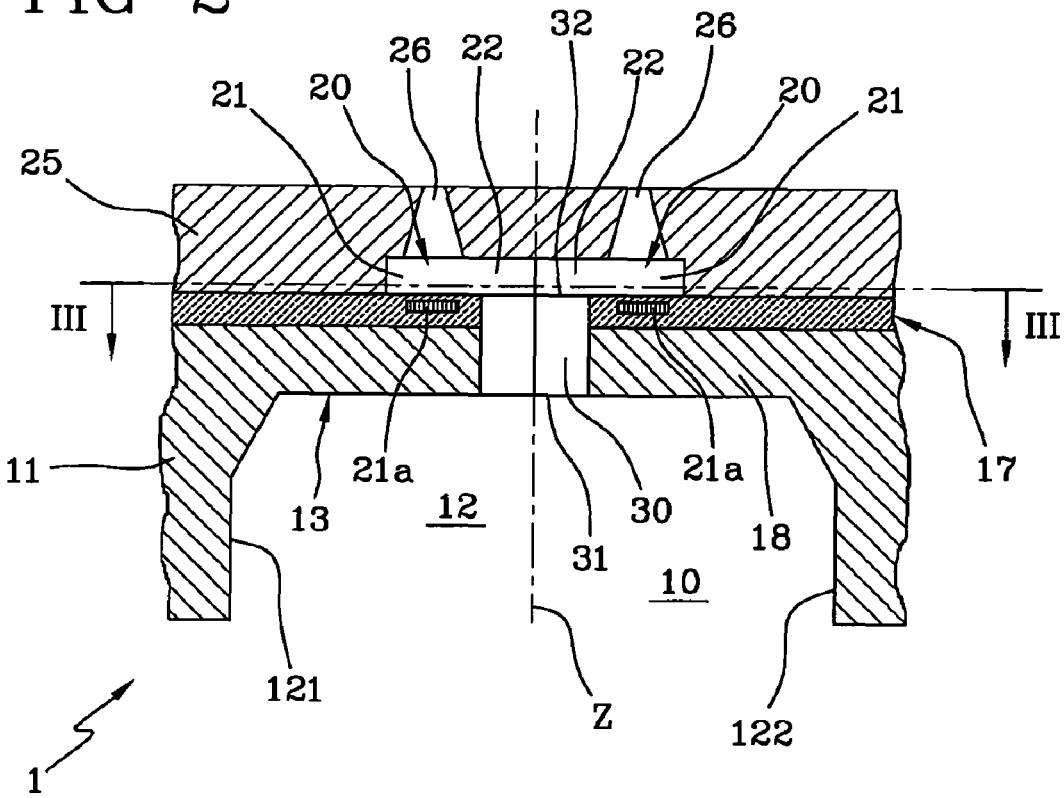
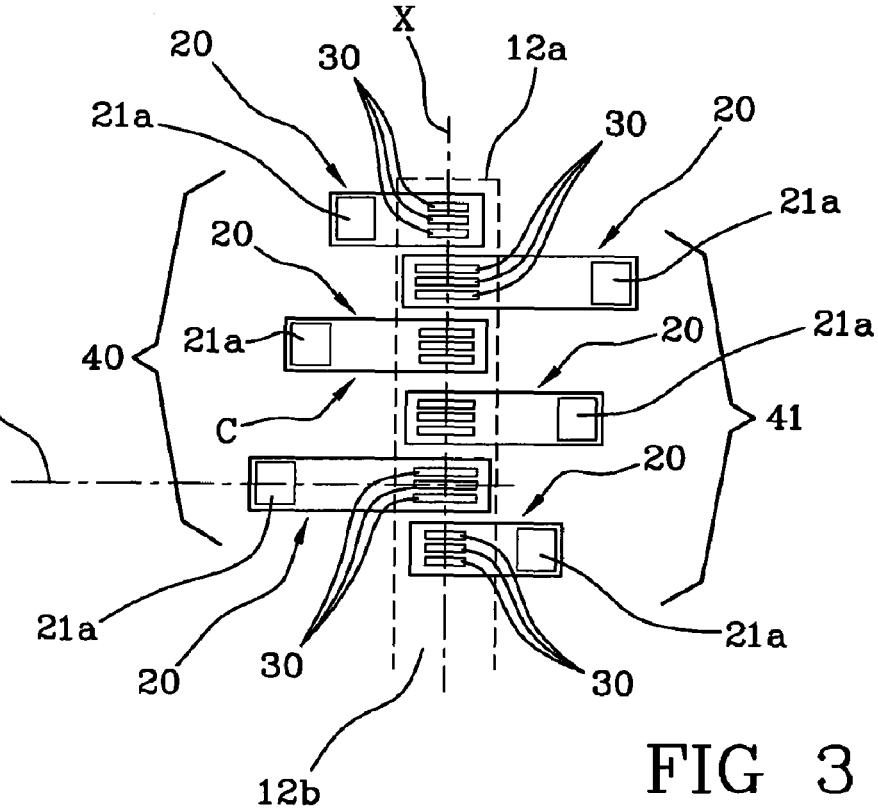
FIG 3

FIG 6
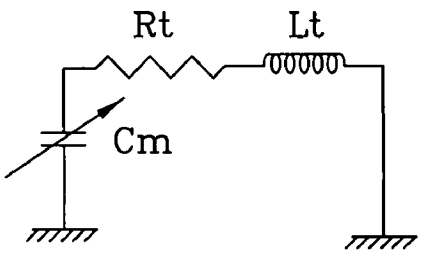
FIG 4
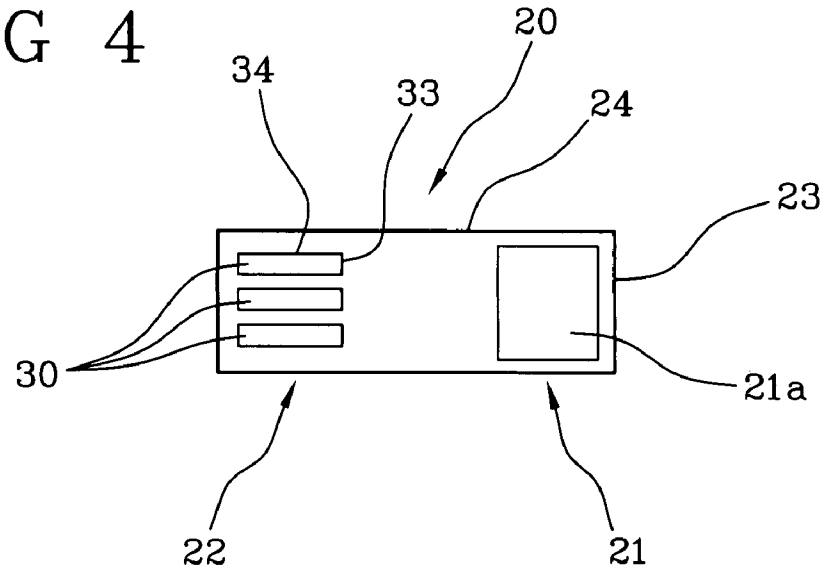
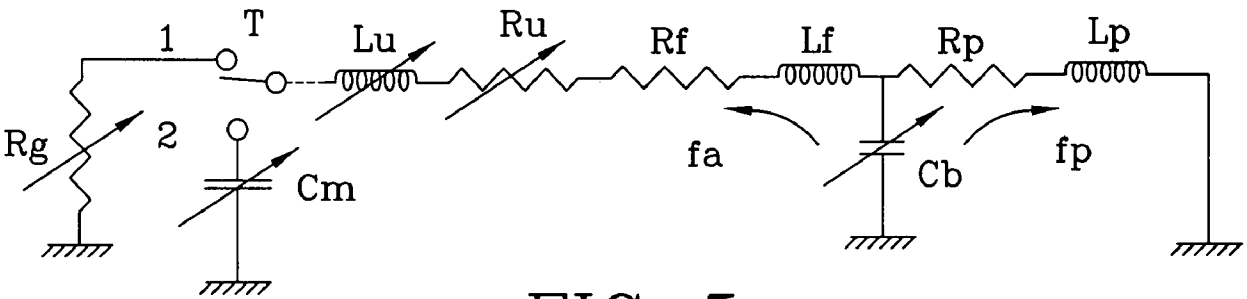
FIG 5

FIG 7
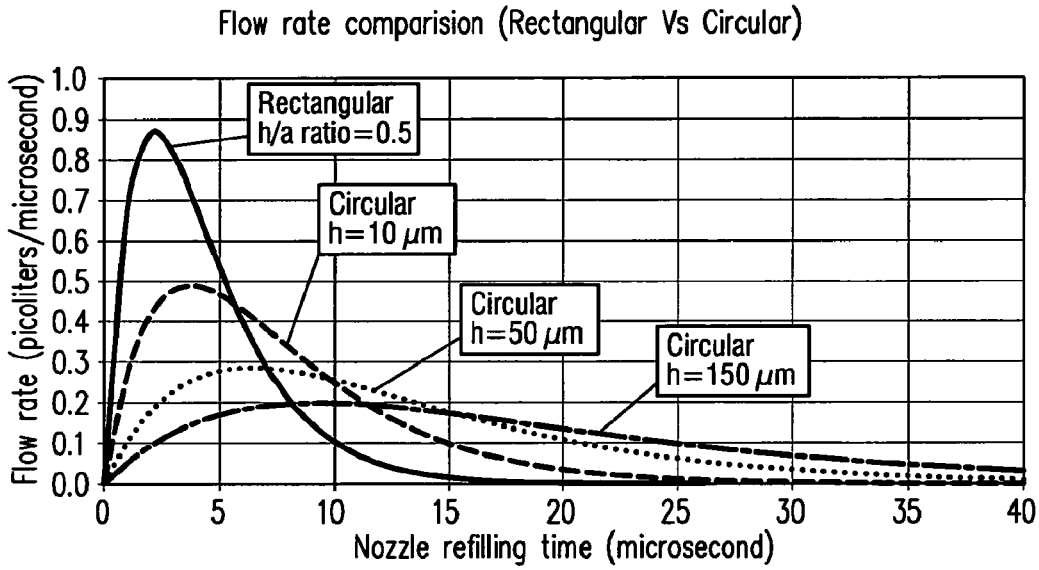
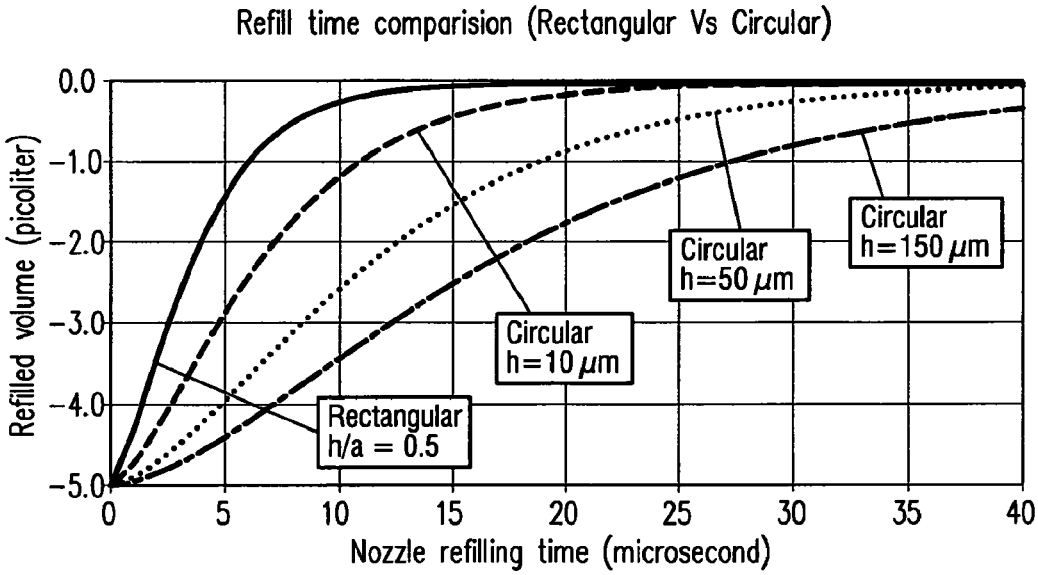
FIG 8

FIG 9

| dpi | Drop volume (pl) | First side (μm) | Nozzle distance (μm) | First lateral side (μm) |
|---|---|---|---|---|
| 300 | 130 | 65 | 85 | 11 |
| 360 | 93 | 55 | 71 | 9 |
| 600 | 33 | 35 | 42 | 6 |
| 720 | 28 | 30 | 35 | 5 |
| 1200 | 8 | 20 | 21 | 3 |

FIG 10

| dpi | Drop volume (pl) | First side (μm) | Nozzle distance (μm) | First lateral side (μm) |
|---|---|---|---|---|
| 300 | 80 | 55 | 85 | 9 |
| 360 | 58 | 47 | 71 | 8 |
| 600 | 20 | 30 | 42 | 5 |
| 720 | 18 | 26 | 35 | 4 |
| 1200 | 5 | 18 | 21 | 3 |

INKJET PRINTHEAD

The present invention relates to an inkjet printhead. In particular, the invention relates to a thermal ink jet printhead.

Inkjet printers print dots by ejecting very small drops of ink onto a print medium, generally paper, and typically include a movable carriage that supports one or more printheads each having ink ejecting nozzles (or orifices). The carriage traverses over the surface of the print medium, and the nozzles are controlled to eject droplets of ink at appropriate times pursuant to commands from a microcomputer or other controller, wherein the timing of the ejection of the ink drops is intended to correspond to the pattern of pixels of the image being printed.

The printheads of thermal ink jet printers include one or more ink reservoirs and a nozzle plate having an array of ink ejecting nozzles, a plurality of ink vaporization chambers in communication with the respective nozzles, and a plurality of heating resistors, known as "firing resistors", within the vaporization chambers and opposite the ink ejecting nozzles which are spaced therefrom by the vaporization chambers.

To print a single dot of ink, an electrical current from an external power supply is passed through a selected heating resistor. Localised heat transfer from the resistor to a defined volume of ink within the vaporization chamber vaporizes said volume of ink and causes it to expand thereby causing a droplet of ink to be ejected through the associated orifice onto a print medium. Properly arranged nozzles form a dot matrix pattern.

In more detail, the ink reservoir is in fluid connection with an ink feed slot, from which a plurality of ducts (or ink feed channels) guide the ink to the vaporization chambers.

Each vaporization chamber can be connected with said ink feed slot by means of one or more ducts.

Current trends in inkjet technology is towards an increase of the density of the nozzle spacing to provide a high print resolution, which can be achieved in one-pass printing.

Typically, adjacent rows of ink drop generators are arranged along the sides of an ink feed slot. If, for example, two rows of generators are associated to an ink feed slot, each row is arranged along a side of the slot. In order to decrease the printing pitch, the plurality of ink drop generators along a first side of an ink slot can be staggered with respect to the pluralities of ink drop generators along the other side of the slot. The extent of stagger between the various rows is such that, as the paper moves, the traces of ink drops from the various nozzles define non-overlapping or slightly overlapping parallel lines. The spacing of these lines determines the effective resolution of the head.

US 2003/0137561 discloses a monolithic printhead in which each chamber is connected with the groove through three ducts having a circular cross section; the ducts are obtained in a layer, referred to as "lamina", which extends between the groove and the chambers.

U.S. Pat. No. 6,719,913 discloses an inkjet printhead in which each chamber is in fluid connection with the groove through a plurality of rectangular ducts arranged parallel to one another.

U.S. Pat. No. 6,402,972 discloses an inkjet printhead in which the vaporization chambers have a frustoconical shape and the groove has a tapered shape converging towards the chambers.

U.S. Pat. No. 6,543,879 discloses an inkjet printhead in which the resistors of the vaporization chambers belonging to one row are staggered with respect to a vertical axis from an ink feed slot to thereby have a varying distance from the ink feed slot. The vaporization chambers include ink feed channels which communicate with the ink feed slot formed in a substrate. The varying distance of the resistors from the slot potentially create differences in ink flow from the ink feed channels to the respective resistors. The ink feed channels have varying opening geometry to offset the varying distances from the respective resistors to the groove. Despite having varying opening geometry, the channels are said to preferentially have substantially the same cross-sectional area to maintain a constant fluidic pressure drop between the slot and the channels.

U.S. Pat. No. 6,890,063 discloses an inkjet printhead including a substrate in which a manifold supplying ink is formed, an ink feed channel connected to a vaporization chamber, and insulating layer which is formed on the substrate and forms lower walls of the vaporization chamber, and an ink feed hole connecting the ink channel to the manifold, wherein the ink feed hole include a plurality of through holes which perforate the insulating layer and through which the ink channel is connected to the manifold.

In printheads for high resolution printing, especially in case of colour printheads, at least three ink feed slots are formed side by side in a substrate.

The Applicant has observed that, in all the above described printheads, a distance exists between the vaporization chambers of adjacent rows of ink drop generators, which are arranged on opposite sides along a vertical length of an ink feed slot. This distance, measured in a direction perpendicular to the vertical length of the slot, sets a limit on the overall horizontal dimension of the printhead, which is generally the direction perpendicular to the vertical length of the ink feed slot(s).

In case of ink feed channels formed through a thin-film structure, since the vaporization chamber associated to each ink drop generator belonging to one row faces at least partly one or more chambers of the row on the opposite side of the slot, the horizontal length of the slot (i.e. the slot width) must be sufficient to allow a fluid connection by means of ducts (or ink feed channels) between the same slot and the chambers of both rows.

Therefore, the overall dimension of the printhead can not be reduced in the horizontal direction, due to the arrangement of the chambers.

The Applicant has realized that by overlapping in the longitudinal direction (i.e. the direction defined by the vertical length of the slot) the chambers belonging to different rows, it is possible to reduce the overall horizontal dimension of the printhead.

In particular, smaller printheads can be realized, thus an increased number of printheads can be realized on a single silicon wafer, thereby reducing production costs.

Furthermore, when ink-feed channels are formed through a thin-film structure, overlapping of the vaporization chambers belonging to opposite rows allows the manufacturing of a relatively narrow thin-film structure, which is thus intrinsically more robust.

In particular, the invention relates to an inkjet printhead, comprising:

- a substrate having an ink feed slot formed in the substrate and having a first longitudinal edge and a second longitudinal edge opposite to said first longitudinal edge, the first longitudinal edge extending along a first longitudinal axis;
- a first row of vaporization chambers arranged along said first longitudinal edge and a second row of vaporization chambers arranged along the second longitudinal edge, in which each chamber comprises an ink droplet generating portion and a connection portion, said connection portion including at least one duct in fluid connection with said ink feed slot, wherein the connection portions of the chambers of the first row overlap along said first longitudinal axis with the connection portions of the chambers of the second row.

In a preferred embodiment, the ducts which fluidly connect the ink feed slot to the vaporization chambers are formed through a bridge structure overlaying the ink feed slot that is formed in a substrate.

Preferably, the ducts have a rectangular cross section on a plane substantially perpendicular to the depth of said ducts along a vertical direction extending from the vaporization chambers to the ink feed slot.

According to a preferred embodiment, the lateral sides of the cross-section of the ducts on a plane substantially perpendicular to their vertical depth (such vertical depth being defined along a direction extending from the vaporization chambers to the ink feed slot) are selected so as to optimize the nozzle refilling time, i.e., the ink feeding to the vaporization chambers, in order to achieve a relatively high ejection frequency, e.g., larger than 50-60 kHz for ink droplets of 2 pl.

By properly dimensioning the sides of the ducts' cross section, it is possible to obtain printheads with an optimized ink feeding while having a relatively thick bridge structure in which the ducts are defined. A relatively thick bridge structure (e.g., of thickness of 50-100 μm) provides a printhead with a stronger and more reliable structure than prior art printheads having thin-film structures of less than 5 μm.

Further features and advantages will become more apparent from the detailed description of a preferred, but not exclusive, embodiment of a printhead in accordance with the present invention. This description will be set out hereinafter with reference to the accompanying drawings, given by way of non-limiting example, in which:

FIG. 2 represents a cross-sectional view along a plane II-II of some ejectors of the printhead according to the invention;

FIG. 3 represents a plan view along a plane III-III of the ejectors of FIG. 1;

FIG. 4 shows an enlarged plan view of portion C shown in FIG. 3;

Figure 1:
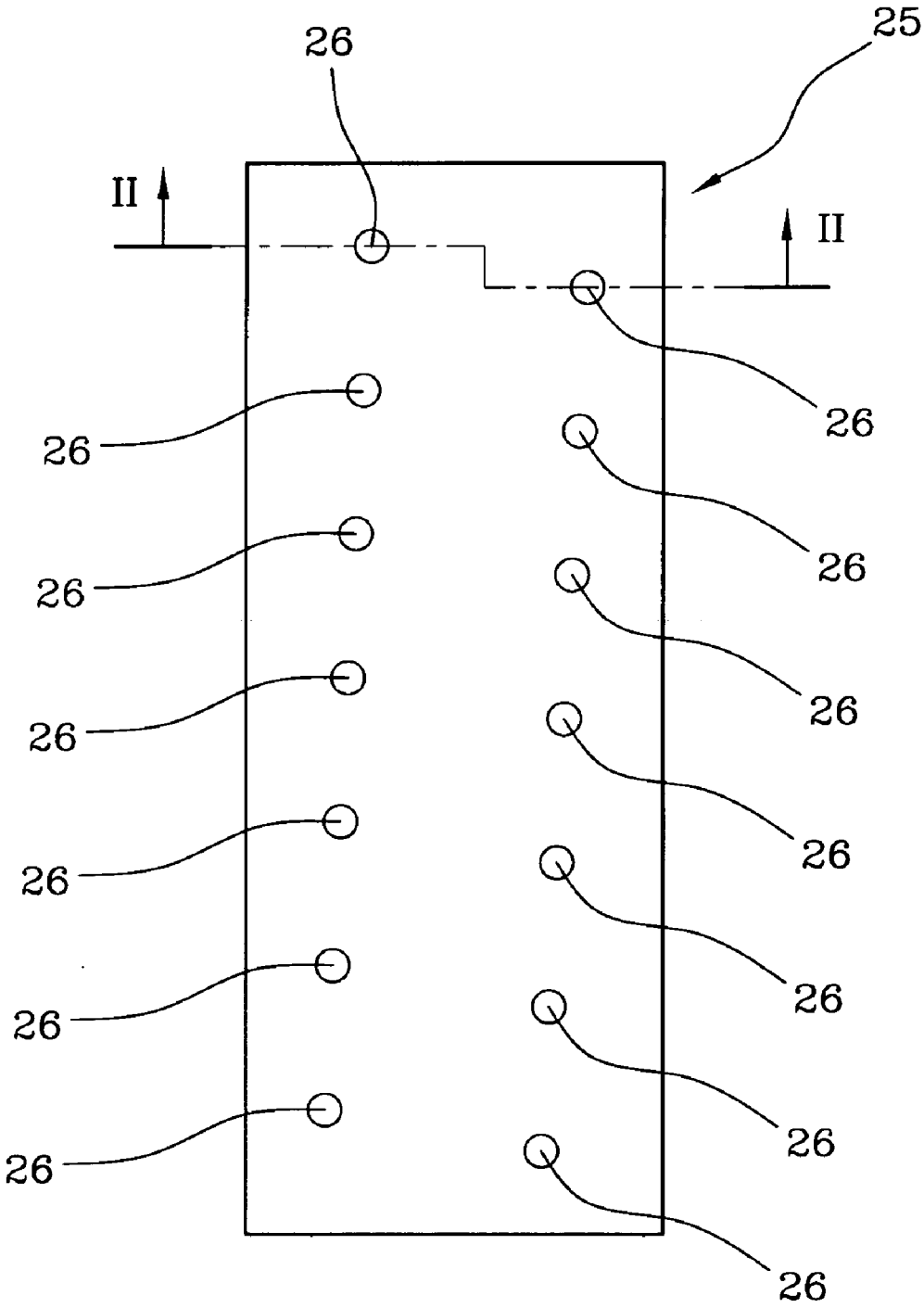
FIG. 1 represents a plan view of a nozzle member of a printhead illustrating a nozzle arrangement in two rows along opposite sides of an ink feed slot (dashed line) according to an embodiment of the present invention.

FIGS. 5 and 6 diagrammatically show electrical circuits equivalent to hydraulic circuits provided in the printhead according to the invention;

FIGS. 7 and 8 are diagrams showing parameters representative of the printhead performances;

FIGS. 9 and 10 are tables showing functional and structural parameters of a printhead according to the present invention.

With reference to the drawings, a printhead in accordance with the present invention has been generally denoted with reference numeral 1.

The printhead 1 comprises a substrate 11, preferably a silicon substrate, and an ink feed slot 12 formed therein.

It is to be noted that in the following (and in the accompanying drawings) only one ink feed slot 12 is referred to; however the printhead 1 according to the present invention may comprise a plurality of ink feed slots, for example arranged side by side in the same substrate.

An ink reservoir 10 (only schematically indicated in FIG. 2) supplies ink to the printhead 1 by being in fluid connection with the ink feed slot 12.

The printhead 1 comprises a plurality of vaporization chambers 20, wherein vapour bubbles are generated in the ink filling the chambers causing the ejection of ink droplets from a plurality of nozzles 26, each vaporization chamber 20 being associated to a respective nozzle 26.

It is to be noted that, although a higher number of nozzles is shown in FIG. 1, for purposes of illustration only, FIG. 3 shows two rows having only three nozzles each.

Each chamber 20 comprises an ink droplet generating portion 21 and a connection portion 22.

In particular, when the ink is boiling, bubbles are generated in the ink, which, by expanding, apply pressure to the ink present in the ink droplet generating portion 21. As a result, a droplet of ink is ejected through the respective nozzle 26.

The ink droplet generating portion 21 comprises a heating resistor 21*a*. An electric current can be passed through a selected heating resistor 21*a* so that an ink bubble is formed within the corresponding selected vaporization chamber 20.

The connection portion 22 includes at least one duct 30, which is fluidly coupled to the chamber 20 and is fluidly coupled to the ink feed slot 12, so that each chamber 20 is in fluid connection with the ink reservoir 10 through the ink feed slot 12.

In the preferred embodiment, the at least one duct 30 included in each connection portion 22 is formed through a bridge structure 13 overlaying the ink feed slot 12. The bridge structure 13 includes a thin-film multilayer 17 formed on top of the substrate 11.

Although not shown in FIG. 2 (only resistors 21*a* are indicated within the thin-film multilayer), the thin-film multilayer 17 may comprise a plurality of thin-film layers including a resistive layer, e.g., Ta/Al, for forming resistor 21*a*. Thin-film multilayer 17 may include also a plurality of protective layers (not shown), for example a $Ta/SiC/Si_3N_4$ multilayer, which cover the resistive layer in order to protect it, and some insulating layers (not shown) between resistors 21*a* and substrate 11. Typically, the thin-film multilayer is 2-3 μm thick.

The ink feed slot 12 can be formed from the back side of the substrate 11 (i.e., opposite to the side, facing the nozzles) by wet etching process, dry etching process or by a combination of the two processes. It is however to be understood that the present invention is not limited to the process forming the slot, which can be made by other methods like laser ablation.

According to a preferred embodiment, the bridge structure 13 comprises the thin-film multilayer 17 and a portion 18 of substrate 11 overlaying the slot 12. This implies that, according to a preferred embodiment, etching is not carried out from the back side through the whole substrate 11, i.e., in a way to expose from the back side the thin-film multilayer 17, but a remaining substrate portion 18 having a certain thickness is left, said portion 18 lying underneath the thin-film multilayer 17. The thickness of the substrate portion 18 preferably is not smaller than 25 μm, e.g. of 50 μm.

As will be explained hereinafter in more detail, the ducts 30 have preferably a rectangular cross-section on a plane perpendicular to the direction extending from the vaporization chambers 20 to the ink feed slot 12; by properly dimensioning such rectangular cross-section, it is possible to realize narrow ducts and thus relatively thick bridge structures, thereby simplifying the production process of the printheads, for instance avoiding the need of an etch-stop layer.

Preferably, the thin-film multilayer 17 is formed on the remaining part 18 the substrate 11 before the ink feed slot 12 is formed in said substrate 11.

Preferably each connection portion 22 includes a plurality of ducts 30. In the embodiment shown in FIGS. 3 and 4, each connection portion 22 comprises three ducts 30.

According to a preferred embodiment, printhead 1 is of monolithic type, i.e., nozzle openings and external walls of vaporization chambers are defined within a single layer 25, which can be a photopolymer layer that is exposed to a multiple exposure process and then developed. Alternatively, nozzle member 25 can be formed in flexible polymer tape, for example polyimide such as Kapton® and polyethylene terephthalate such as Mylar®, which can be laser ablated to form the nozzles and the vaporization chambers.

It is however to be understood that the present invention envisages also a printhead having a barrier layer, in which the vaporization chambers are formed, and a separate nozzle plate, in which nozzles openings are formed (e.g., an Au-coated Ni plate or plastic plate).

In case of black ink, the volume of each droplet can be comprised for example between 2 μl and 130 pl; in case of coloured ink, the volume of each droplet can be comprised for example between 1 μl and 80 pl.

The ink feed slot 12 has a first longitudinal edge 121 and a second longitudinal edge 122 opposite to said first longitudinal edge 121, both edges extending along a first longitudinal axis X.

The chambers 20 are arranged in a first row 40 and a second row 41. Chambers 20 of said first row 40 are arranged so that heating resistors 21*a* (i.e., the ink droplet generation portion 21) included in the same chambers are arranged adjacent to the first longitudinal edge 121 of the ink feed slot 12 and closer to the first longitudinal edge 121 than to the second longitudinal edge 122 of the slot. In some embodiments, the heating resistors 21*a* of chambers of the first row 40 are arranged closer to the first longitudinal edge 121 than the heating resistors 21*a* of the chambers 20 of the second row 41.

The connection portions 22 of the chambers 20 of the first row 40 overlap the connection portions 22 of the chambers 20 of the second row 41 along the first longitudinal axis X.

In such a way the chambers 20 of different rows can be arranged closer to each other in the horizontal direction of the printhead. The horizontal direction of the printhead can be defined along a second longitudinal axis Y which extends from the ink droplet generating portion 21 to the connection portion 22 of a single chamber 20, said second axis Y being preferably substantially perpendicular to the X axis. In particular, the ink droplet generating portions 21 (i.e. heating resistors 21*a*) of chambers 20 belonging to different rows are closer to each other along the second axis Y.

Advantageously, by overlapping the vaporization chambers 20 of different rows along the longitudinal edges 121, 122 of an ink feed slot, an ink feed slot 12 with a relative small width, i.e., along the Y axis, can be produced, and thus the overall horizontal dimension of the printhead 1 can be reduced without changing the shape or dimensions of the chambers.

Ducts 30 of vaporization chambers 20 have a first lateral side 33 of size b and a second lateral side 34 of size a (FIG. 3), defining the cross-section of the ducts through which the ink is fed to the chambers.

Preferably, the second lateral side 34 of ducts 30 extends along the Y axis and varies with the distance along said Y axis of the ink droplet generating portions 21 from the first edge 121 of the ink feed slot 12 for the first row 40 and from the second edge 122 for the second row 41 of vaporization chambers. Each duct 30 is in fluid connection with the ink feed slot 12 and is adapted to convey ink from the ink feed slot 12 to a single chamber 20.

In particular, each duct 30 communicates with the ink feed slot 12 along a vertical direction extending from the vaporization chamber 20 to the ink feed slot 12.

In case of ducts formed through a bridge structure 13, the vertical depth of ducts is defined along a third longitudinal axis Z (FIG. 2), which is preferably substantially perpendicular to the X axis.

Preferably, the third longitudinal axis z is substantially perpendicular to the second longitudinal axis Y.

Preferably, the ducts 30 of each chamber 20 are substantially parallel to each other.

Preferably each duct 30 has a substantially rectangular cross section on a plane substantially perpendicular to the third longitudinal axis Z.

In particular, the first and second lateral sides 33, 34 of the rectangular cross section of each duct 30 are defined respectively along said first axis X and said second axis Y.

In a preferred embodiment, each chamber 20 includes a plurality of ducts 30, all ducts 30 connected to a certain chamber 20 preferably having the same first lateral side 33 and the same second lateral side 34. Preferably, the first lateral side 33 of all the ducts 30 (although connected to different chambers 20) have the same size b.

As will be apparent in the following, in order to optimize the printhead performances it is advantageous to provide ducts 30 having a first lateral side which is very small compared to the second lateral side.

Selection of a suitable value of the first lateral side 33 depends also on the volume of the ink droplets to be ejected. For example, in chambers adapted to eject droplets of 2 pl, the first lateral side can have a size of 3 μm; for generating smaller droplets (for example having a volume of 0.5 pl), the length of the first lateral side might be comprised between 0.3 and 0.5 μm.

Current technology, e.g., etching technology, may pose a lower limit in the definition of the first lateral side 33, especially for ducts having relatively high aspect ratio. However, as it will apparent in the following, selecting a small b value, in dependence also on the ink droplet volume (e.g., b=3 μm for 2 pl ink droplets), can be particular advantageous.

Ducts can be formed by etching, e.g., dry etching, through the bridge structure before the formation of the ink feed slot.

Preferably, each chamber 20 has a substantially rectangular bottom wall.

In particular, each chamber 20 can be in the shape of a parallelepiped, having a bottom wall defined by a portion of the upper surface (i.e., facing the nozzle member) of the thin-film multilayer 17.

According to a preferred embodiment, the nozzle member 25 is formed on the substrate 11; cavities in the nozzle member 25 define upper and side walls of the chambers 20; the bridge structure 13 (in particular the thin-film multilayer 17) defines bottom walls of said chambers 20.

In practice, each chamber 20 is defined by a respective cavity in the nozzle member 25 (defining in particular upper and side walls of the chamber), each cavity being closed at its bottom by the bridge structure 13.

Heating resistors 21*a*, and thus nozzles 26 are preferably staggered along the Y axis. In the embodiment shown in FIGS. 1 and 3, the second sides 24 of the chambers 20 of the first row 40 have a length increasing along the first longitudinal axis X, such a length being dependent on the distance of the ink generating portion 21 of the first row to the first longitudinal edge 121 along the Y axis.

On the other hand, the second lateral sides 24 of the chambers 20 of the second row 41 have a length decreasing along the first longitudinal axis X, such a length being dependent on the distance of the ink generating portion 21 of the second row to the second longitudinal edge 122 along the Y axis.

It is to be noted that the arrangement of the chambers 20 illustrated in FIGS. 1 and 3, is a particular and simplified example of staggered arrangement of nozzles 26 for illustration purposes. It is however to be understood that other kinds of staggered arrangements, not necessarily along a single tilted line with respect to the X axis, are envisaged.

Further, although in FIG. 3 only three nozzles per row are shown for illustration purposes, groups of staggered nozzles including a higher number of nozzles, such as 15-20 for example, can be present.

Each row preferably comprises a plurality of groups of nozzles, e.g. 128 nozzles divided in groups of 16 staggered nozzles.

Preferably, the second lateral side 34 of the rectangular cross section of the ducts 30 is proportional to the length of the second side 24 of the rectangular bottom wall of the chamber 20 to which said ducts 30 are connected; in other words, the smaller the second side 24 of the bottom wall of a chamber 20, the smaller the second lateral side 34 of the duct(s) connected to such chamber 20.

In general, the second lateral side 34 of the ducts 30 within a chamber are dimensioned such a way that the hydraulic impedance of the path from the ink feed slot 12 to the ink droplet generating portion 21 of each chamber 20 is substantially the same.

To describe the operation of a chamber 20 and the nozzle 26 associated thereto to define an ink droplet ejector, an electrical analogy can be used in which the following equivalences are established:

V=electrical voltage in V→pressure in N/m$^2$
I=current in A→flow rate in m$^3$/S
R=resistance in Ω→hydraulic resistance in N s/m$^5$
L=inductance in H→hydraulic inertance in kg/m$^4$
C=capacitance in F hydraulic compliance in m$^5$/N In the equivalent diagram of FIG. 5, the bubble generated by the ink boiling corresponds to a variable capacitance Cb.

There is a front branch, equivalent to the whole formed the chamber 20, the nozzle 26, the surface of the ink (which can be referred to as "meniscus") and the droplet which is generated; there is also a rear branch, which represents the section of the hydraulic circuit between the chamber 20 and the ink feed slot 12.

The front branch comprises a fixed impedance Lf, Rf corresponding to the chamber 20, a variable impedance Lu, Ru corresponding to the nozzle 26, and a switch T. During the phase in which droplet is formed, the switch T introduces a variable resistance Rg corresponding to the energy occurred to the droplet formation itself. During the phases of withdrawal of the ink surface, of filling the nozzle 26, of subsequent oscillation and damping of the ink surface, the switch T introduces a capacitance Cm corresponding to the ink surface. Ejection of the ink takes place in accordance with the following phases:

An electronic control circuit supplies energy to the resistor 21*a*, so as to produce a local boiling of the ink with formation of the bubble of vapour in expansion. During this phase, in the equivalent electric circuit of FIG. 5, the variable resistance Rg is introduced. The bubble generates two opposing flows: fp (towards the ink feed slot 12) and fa (towards the nozzle 26).

The electronic circuit completes the delivery of energy to the resistor 21*a*, the vapour condenses, the bubble collapses, the droplet is ejected, the ink surface withdraws emptying the nozzle 26. There remain difference between the two opposing flows fp and fa. In this phase, in the equivalent circuit of FIG. 5, the capacitance Cm corresponding to the ink surface is introduced.

The bubble has disappeared and consequently its capacitance, Cb, has become zero. The meniscus draws back by emptying the nozzle 26, thereby sucking new ink into the nozzle 26. After the withdrawal of the meniscus is completed, the ink surface hooks to the outer edge of the nozzle and starts oscillating like a vibrating membrane. In the equivalent circuit of FIG. 5, the capacitance Cm is still present. During the oscillation, the equivalent circuit of the ejector is simplified as diagrammatically shown in FIG. 6, where Cm represents the capacitance of the ink surface, while Rt and Lt represent respectively the sum of all the resistances and of all the inductances present between the ink surface and the ink feed slot 12.

To obtain optimal operation of the ejector, it is necessary for the ink surface to reach the idle state H rapidly without oscillations. In this way, the ink does not wet the outer surface of the nozzle plate 25, thereby avoiding modifications of speed and volume of the successive droplets.

For the ink surface to reach the idle state rapidly without oscillating, the equivalent circuit of FIG. 6 must be in the condition of "critical damping", which corresponds to the following relation:

$$Rt = 2 * \sqrt{\frac{Lt}{Cm}} \tag{1}$$

or $$(Ra + Rp) = 2 * \sqrt{\frac{(La + Lp)}{Cm}}$$

wherein Ra and La are representative of the sum of all the impedances of the front branch, and Rp and Lp are representative of the sum of all the impedances of the rear branch.

In order to select the parameters that can be varied for improving the functioning of the ejector, the dimensions of the nozzle 26 and of the chamber 20 can be defined according to the desired volume of the droplet to be generated and ejected.

Thus only the hydraulic rear portion can be modified for obtaining a "critical damping" type circuit.

A minimum nozzle refilling time in condition of critical damping of the ink surface is to be achieved and therefore it is necessary to optimize the H expression of the flow rate f of the circuit of FIG. 6 to the case of critical damping; for obtaining such a result the above disclosed electro-hydraulic analogy will be used.

In an electric RLC circuit, in which an initial charge $Q_0$ is present, the current i in the case of critical damping is described by the equation:

$$i = Q_0 \frac{R_t^2}{4L_t^2} * t * e^{-\frac{t*R_t}{2*L_t}} \tag{2}$$

Applying the above mentioned electro-hydraulic equivalences the following equation is obtained:

$$f = V_0 \frac{R_t^2}{4L_t^2} * t * e^{-\frac{t*R_L}{2*L_t}} \tag{3}$$

wherein $V_0$ is the volume of the ink missing in the nozzle following the droplet ejection. Therefore, Equation (3) describes the refilling phase.

A time constant τ is defined by the following relation:

$$\tau = \frac{L_t}{R_t} \tag{4}$$

Thus, Equation (3) can be rewritten as $$f = \frac{V_0}{4 * \tau^2} * t * e^{-\frac{t}{2*\tau}} \tag{5}$$

It is to be noted that the flow rate f increases upon decrease of the time constant τ. Since the flow rate ($m^3/s$) is the time derivative of the volume of a liquid that flows in a conduit, a high flow rate causes a decrease of the nozzle refilling time.

Further, exponent $-t/2\tau$ indicates that for low values of the time constant the flow rate rapidly decreases in time.

The values of the time constant τ and of the parameters that define the same time constant τ will be discusses hereinafter.

In order to obtain a "critical damping" behavior of the system according to Equations (2) and (3), high resistances are provided in the rear branch of the circuit, so that the rear branch gives rise to the dominant contribution in the equations with respect to the front branch.

As a consequence, for evaluating and calculating the impedance values, it is possible to take into consideration only the most significant portion (namely the rear branch) of the hydraulic circuit, such portion corresponding to the ducts 30 formed in the bridge structure 13.

Therefore the impedance of the ducts 30 will be considered as representative of the total impedance of the whole hydraulic circuit and the values of the resistance and inductance thereof will be referred to as R and L.

For ducts having rectangular cross section, R and L are defined by the following equations:

$$R \cong \frac{12 * \rho * \upsilon * h}{N * b^3 * a} \tag{6}$$

$$L \cong \frac{\rho * h}{N * b * a} \tag{7}$$

and the time constant i is defined as:

$$\tau = \frac{L}{R} = \frac{b^2}{12 * \upsilon} \tag{8}$$

wherein:

- a is the second lateral side 34 of the rectangular cross section of the duct 30;
- b is the first lateral side 33 of the rectangular cross section of the duct 30, equation (8) being valid for b<<a;
- h is the depth of the vertical length of the duct 30; such a depth coinciding with the thickness of the bridge structure 13;
- N is the number of ducts 30 connected to a single chamber 20;
- ρ is the ink density ($kg/m^3$);
- ν is the ink viscosity ($m^2/s$).

It is to be noted that for rectangular ducts (in which b<<a), the time constant τ basically depends only on the first lateral side 33 (referred to as "b" in the equations).

By contrast, the time constant τ does not depend on a (the second lateral side 34), N (the number of ducts) and h (the duct length).

Thus combining equations (5) and (8), a relation between the flow rate f and the dimension b is obtained;

$$f = \frac{36 * V_0 * \upsilon^2}{b^4} * t * e^{-\frac{6*t*\upsilon}{b^2}} \tag{9}$$

By minimizing dimension b, it is possible both to maximize the flow rate and to minimize the time constant τ, thereby slowing the time evolution of the same flow rate.

It must be noted that equation (9) is valid only in critical damping conditions, i.e. when equation (1) is satisfied.

Combining equations (1), (6) and (7) the following expression for dimension b can be obtained:

$$b = \sqrt[5]{36 * C_m * \upsilon^2 * \rho} * \sqrt[5]{\frac{h}{a * N}} \tag{10}$$

Under the first fifth-root the substantially fixed parameters are grouped (such as nozzle dimension and ink parameters), whereas under the second fifth-root parameters which can be varied for optimizing the ejector working are grouped.

Equation (10) is valid for ducts substantially parallel to each other and having a rectangular cross section.

For comparison, in the following, the equations for circular ducts of radius r are given:

$$f = \frac{16 * V_0 * \upsilon^2}{r^4} * t * e^{-\frac{4*t*\upsilon}{r^2}} \tag{11}$$

$$r = \sqrt[6]{16 * C_m * \upsilon^2 * \rho} * \sqrt[6]{\frac{h'}{N}} \tag{12}$$

In case of circular ducts—Equation (12)—only two parameters can be varied (N, h') in order to obtain the r value, whereas in case of rectangular ducts three parameters can be varied (N, h, a) in order to obtain b—Equation (10).

In particular, in order to obtain a small value of r, the depth h' of circular ducts (i.e. the thickness of the thin-film membrane) must be small, causing a significant fragility of the thin-film membrane.

By contrast, using ducts having a rectangular cross section it is possible to employ the thickness of the bridge structure (h) that can be composed not only by a thin-film multilayer but also by a silicon slab (i.e the portion 18 of the substrate 11) while increasing also the dimension a (the second lateral side 34), thereby obtaining a stronger and more reliable bridge structure.

FIGS. 7 and 8 are graphical illustrations of the flow rate and the refilled volume as a function of the refill time wherein comparison between rectangular ducts and circular ducts is shown.

It is to be noted that, by properly choosing the value of the ratio h/a, a higher flow rate in critical damping condition and a higher nozzle refilling velocity can be achieved.

Since from Equation (10) b depends only on the ratio h/a, both the h value and a value can be varied for further optimization.

For example, among the following pairs of values h=10 μm, a=20 μm h=50 μm, a=100 μm h=150 μm, a=300 μm the third value pair (h=150 μm, a=300 μm) can be selected, so that the thin film membrane is thicker, thereby obtaining the above described advantages in terms of strength and reliability.

Further, FIGS. 7 and 8 show that, in case of circular ducts, the flow rate and the refill time significantly depend on the thickness of the bridge structure (h).

FIGS. 9 and 10 are tables in which, for different values of the printing density (dpi) and the droplet volume, the values for the first side 23 of the chamber 20, the distance between the nozzles 26, and the first lateral side 33 of the ducts 30 are shown.

The nozzle distance referred to in FIGS. 9 and 10 is the distance between two contiguous nozzles belonging to different rows.

The values presented in FIGS. 9 and 10 have been calculated for a printhead in which the ratio h/a is equal to 0.5, which corresponds for example to h=50 μm and a=100 μm, and for N=3.

In particular, FIG. 9 refers to black ink, which has a relatively high surface tension and thus generally requires a relative high drop volume. Black ink is mostly used for printing alphanumeric symbols. FIG. 10 refers to colored ink, which has a lower surface tension and generally requires lower drop volume due to its high spreading characteristic and can be used to print pictures.

The length, b, of the first lateral side 33 is selected in dependence on the volume of the ink droplet which is to be generated and on the flow of ink required in the ducts 30.

In particular the volume of the ink droplet depends on the required printing density: the higher the density (dpi) of dots, the smaller the volume of each droplet and thus the smaller the area of each heating resistor; as a consequence, to achieve a high dpi the dimensions of each chamber 20 can be properly reduced.

Further, the flow in the ducts 30 should be preferably sufficient to ensure a short refilling time so as to obtain an acceptable working frequency of the printhead.

In particular, in order to satisfy the constraints regarding the refilling time, a solution provided with a higher number of ducts having a smaller value of b is to be preferred to a solution provided with a lower number of ducts having a larger value of b.

In such a way the hydraulic resistance of the ducts 30 is decreased, while no changes occur with respect to the damping, thereby reducing the refilling time and improving the printhead working frequency.

In view of the above, dimensions of the vaporization chambers depend on the droplet volume (i.e. the printing density), whereas by varying the dimensions of the ducts it is possible to optimize the printhead working in terms of achievement of critical damping and refilling time.

The invention claimed is:

1. An inkjet printhead comprising:

a substrate having an ink feed slot formed in the substrate and having a first longitudinal edge and a second longitudinal edge opposite to said first longitudinal edge, the first longitudinal edge extending along a first longitudinal axis (X);

a first row of vaporization chambers arranged along said first longitudinal edge and a second row of vaporization chambers arranged along the second longitudinal edge, in which each chamber comprises an ink droplet generating portion and a connection portion, said connection portion including at least one duct in fluid connection with said ink feed slot, wherein the connection portions of the chambers of the first row overlap along said first longitudinal axis (X) with the connection portions of the chambers of the second row;

wherein each of said ducts has a first end in fluid connection with said ink feed slot and a second end connected with only one of said chambers, and each of said ducts extends between said ink feed slot and said chamber along a substantially rectilinear direction;

wherein each of said ducts has a first lateral side extending substantially parallel to said first longitudinal axis (X) and a second lateral side extending substantially parallel to a second longitudinal axis (Y) that extends from the ink droplet generating portion to the connection portion of at least one of said chambers;

wherein the second lateral side of each duct defines a length that varies along the first and second rows based on the distance of the respective ink generating portion along the second direction (Y) from the respective first longitudinal edge or second longitudinal edge of the ink feed slot.

2. The printhead according to claim 1, further comprising an ink reservoir, wherein said ink feed slot is in fluid connection with said ink reservoir.

3. The printhead according to claim 1, wherein said at least one duct is formed through a bridge structure overlaying said ink feed slot.

4. The printhead according to claim 3, wherein said bridge structure comprises a thin-film multilayer.

5. The printhead according to claim 3, wherein said bridge structure comprises a portion of said substrate overlaying said ink feed slot.

6. The printhead according to claim 1, wherein said second axis (Y) is substantially perpendicular to said first axis (X).

7. The printhead according to claim 1, wherein said at least one duct is a plurality of ducts.

8. The printhead according to claim 1, wherein said ducts are substantially parallel to each other.

9. The printhead according to claim 1, wherein each of said ducts has a substantially rectangular cross section on a plane substantially perpendicular to a third longitudinal axis (Z) defined between the chamber to which said duct is connected and said ink feed slot.

10. The printhead according to claim 9, wherein the at least one duct connected to one of said chambers is a plurality of ducts having first lateral sides of the same length (b) and second lateral sides of the same length (a).

11. The printhead according to claim 9, wherein the first lateral sides of the rectangular cross section of said ducts of the chambers of the first row and of the second row have substantially the same length (b).

12. The printhead according to claim 1, wherein each of said chambers has a substantially rectangular bottom wall defined by a portion of the upper surface of said bridge structure.

13. The printhead according to claim 12, wherein the rectangular bottom wall of said chambers has a first side substantially parallel to the first axis (X), and a second side substantially perpendicular to said first side.

14. The printhead according to claim 13, wherein the first sides of said chambers have substantially the same length.

15. The printhead according to claim 14, wherein the second side of each chamber and the length dimension of the rectangular cross section of the ducts connected to said chamber are dimensioned in such a way that the hydraulic impedance of the path from the ink feed slot to the ink droplet generating portion of each chamber is substantially the same.

16. The printhead according to claim 1, wherein the ink droplet generating portion of each chamber comprises a resistor.

17. The printhead according to claim 1, wherein the distance between the first edge of said ink feed slot and the ink generating portions of the chambers of said first and/or second rows varies with the position of said chambers along the first longitudinal axis (X).

* * * * *